United States Patent [19]

Hartmann et al.

[11] 4,123,749

[45] Oct. 31, 1978

[54] METHOD AND SYSTEM FOR DETERMINING THE PRESENCE OF OBJECTS WITHIN A PARTICULAR SURVEILLANCE AREA, IN PARTICULAR FOR PREVENTION OF SHOPLIFTING

[75] Inventors: Ernst G. Hartmann, Hilden; Hans Krech, Kaarst; Franz Meir, Waldenbuch, all of Fed. Rep. of Germany

[73] Assignee: Bizerba-Werke Wilhelm Kraut KG, Balingen, Fed. Rep. of Germany

[21] Appl. No.: 782,098

[22] Filed: Mar. 28, 1977

[30] Foreign Application Priority Data

| | | | |
|---|---|---|---|
| Apr. 3, 1976 | [DE] | Fed. Rep. of Germany | 2614429 |
| Sep. 1, 1976 | [DE] | Fed. Rep. of Germany | 2639284 |
| Sep. 17, 1976 | [DE] | Fed. Rep. of Germany | 2641876 |

[51] Int. Cl.[2] ..... G08B 13/24

[52] U.S. Cl. ..... 340/572

[58] Field of Search ..... 340/280, 258 C

[56] References Cited

U.S. PATENT DOCUMENTS

| | | | |
|---|---|---|---|
| 3,765,007 | 10/1973 | Elder | 340/280 |
| 3,820,104 | 6/1974 | Fearon | 340/280 |
| 3,838,409 | 9/1974 | Minasy et al. | 340/280 |

*Primary Examiner*—Glen R. Swann, III

*Attorney, Agent, or Firm*—Hauke and Patalidis

[57] ABSTRACT

A surveillance system for preventing shoplifting comprises marking elements made of material of high magnetic permeability attached to the goods in a store, and magnetic field generating coils generating a magnetic field in the exit areas from the store. Two different alternating magnetic fields are produced on opposite sides so that the configuration of the field within the exit area is continuously changing. Introduction of a marking element into this area causes different frequencies to be produced which are sensed by a sensing element which then emits a signal. The marking elements can be deactivated during a normal purchase by magnetically saturating the material.

11 Claims, 22 Drawing Figures

$$\left[\begin{array}{l} i_1 = I \sin \omega t \\ i_2 = I \sin (\omega t + 90°) \end{array}\right]$$

$i_1 = 0$ $i_2 = I$ $\omega t = 0$ $i_1 = i_2 = \frac{1}{2}\sqrt{2}\, I$ $\omega t = 45°$ $i_1 = I$ $i_2 = 0$ $\omega t = 90°$ $i_1 = \frac{1}{2}\sqrt{3}\ I$
$i_2 = -\frac{1}{2}\ I$ $i_1 = \frac{1}{2}\ I$
$i_2 = -\frac{1}{2}\sqrt{3}\ I$ $i_1 = 0$
$i_2 = -\ I$

METHOD AND SYSTEM FOR DETERMINING THE PRESENCE OF OBJECTS WITHIN A PARTICULAR SURVEILLANCE AREA, IN PARTICULAR FOR PREVENTION OF SHOPLIFTING

FIELD OF THE INVENTION

The invention relates to a method and a system for determining the presence of objects within a particular surveillance area in particular for detection of prohibited removals during shoplifting and the like.

BACKGROUND OF THE INVENTION

Systems of this kind are known, for example from the U.S. Pat. Nos. 3,631,422, 3,747,086, 3,754,226, 3,820,104, 3,820,103, 3,790,945, as well as from the German Offenlegungsschrift No. 2,160,041. Since the surveillance system described in the German specification No. 2,160,041 substantially represents a combination of the systems described in the said U.S. patent specifications, only the Offenlegungsschrift will be dealt with in detail in the following. In the system described therein, the procedure applied in the simplest case is that at least one magnetic field is generated in the area of an exit door of a store, warehouse or the like. The objects sold in the store carry marking elements which may be affected by the magnetic field. A non-linear behaviour of the marking element may be produced in the commonest case, so that frequencies differing from the excitation frequencies or frequency and detectable by sensors are engendered if a proper sale has not been made.

In particular, the procedure applied in such case is that two alternating magnetic fields are engendered by appropriately aligned coils within the area of the exit door. The coils generating the magnetic fields are carefully tuned with respect to each other in such a manner that no mutual induction occurs, so that the fields cannot affect each other. If the marking element, which consists of magnetic material of high permeability, is then however brought between the oscillation components of the overall field formed within the exit area, said element normally has a direction enabling the two magnetic fields generated to drive the magnetic material of the marking element into the saturated state, that is to say at either side of the known hysteresis loop, since these are alternating magnetic fields. Since these magnetic actions have a considerable non-linearity, addition and subtraction signals are produced from the two excitation frequencies are transmitted in the form of electromagnetic radiation by the marking element. In a specified embodiment, the excitation frequency of one field amounts to 21 kc/s, and the excitation frequency of the other magnetic field amounting to 24.5 kc/s. It is possible to detect a corresponding differential frequency of 3.5 kc/s, which is transmitted by the marking element among many other frequencies, to appropriate sensors in resonance with this frequency, to produce a corresponding signal. What is essential in a system of this kind is merely that the two excitation frequencies do not affect each other mutually from the beginning and that no corresponding summation or differentiation signals are engendered, so that any mutual induction should be prevented painstakingly in the case of coils engendering the alternating magnetic fields. Upon application of one coil only, it is also possible to interpose appropriate filters between the coil and the excitation systems in question, so that non-linearities and the forming of corresponding modulation frequencies are prevented. On the other hand a system of this nature also operates if a single magnetic field is merely generated and brought into action on the marking element, because the marking element generates harmonics of the basic oscillation, which would not be present in the absence of the marking element, which may however be picked up and exploited for providing an appropriate warning.

It is already known moreover to affect the marking element upon proper completion of a sale, in such manner that the generation of harmonics — or of the said summation and differentiation signals if the operation is performed with two different frequencies — is prevented. For example, the marking element may consist of a magnetic material of high permeability which is brought together with a second ferromagnetic element of high coercivity. If a permanent magnetization is then imparted to this second element, for example in the area of the store cash register, this second magnetic element is able to keep the first magnetic element in a constant state of saturation, so that the action of the alternating magnetic fields in the area of the door can no longer have any effect, since the hysteresis loop is no longer passed through, so that the non-linearities are also suppressed.

It is evident that a system of this kind may operate properly only if it is assured that the marking element is always able to respond to the magnetic field or fields within the surveillance area, i.e. the magnetic fields should be so directed spatially that there is substantially no position for the marking element which can prevent the generation of the harmonics attributable to the non-linearities. It may well be assumed that the occasional user has no knowledge of the orientation of the magnetic fields in the surveillance area, i.e. normally in the area of the exit door. If, however, the object comprising the marking element is held so that one of the directional magnetic fields cannot act on the magnetic material of high permeability of the marking element, the forming of the summation or differential frequencies does not occur either and the transmission of a signal does not take place. In other terms, this means that the possibility of the presence of so-called blind spots cannot be excluded.

SUMMARY OF THE INVENTION

The invention provides a surveillance method and a system appropriate for application of the method, wherein these blind spots are prevented, and which ensure an orientation and structure of the magnetic fields or field within the surveillance area, such that it is impossible to evade the generation of harmonics by the marking element, when the latter has not been "disarmed". It is also of importance in this connection that harmonics are essentially not generated in the absence of a marking element.

The invention is based on the method cited in the foregoing and consists in that for prevention of mutual influence and for a suppression of generation of harmonic or modulation frequencies attributable merely to undesirable coupling, the feeding of the magnetic field generating systems is performed with applied current, at least one harmonic signal which represents at least double or a multiple of the basic or rather generator frequency then being generated by virtue of the non-linearity of the marking element introduced, and being evaluated.

An advantageous embodiment of the invention consists in that the alternating magnetic fields of both generator systems are coupled together to form a common magnetic field, and that the excitation frequencies of the magnetic fields differ in frequency to the extent that an overall magnetic field is generated in the surveillance area, in the manner of a beat which travels and varies constantly in respect of direction, strength and position.

The invention is based on the finding that the forming of "blind spots" may be prevented effectively by omitting to set up the magnetic alternating fields which may well change their polarity at high frequency but are otherwise present in spatially fixed manner, and by reverting, so-to-say, to a "travelling" magnetic field which has a different configuration and direction, position and field strength at any instant. Since the variation of the momentarily generated overall magnetic field is not predictable, or in any event occurs so quickly as regards a user of the system, the user cannot safely follow the original variation by appropriately moving the marking element upon passing through the surveillance area. Consequently, the marking element is picked up reliably by the varying magnetic fields at any time and in any event, within the surveillance area.

Complementarily, the invention is not restricted to the generation of an interpretable signal which is obtained by forming the sum or difference of the two excitation frequencies, but it is merely necessary for the magnetic material of the marking element to be detected by the travelling magnetic field in some manner and to some time and then to be correspondingly reversed magnetically since this magnetic field also has a high frequency of variation. Harmonic signals then result because of the non-linearities in the case of magnetic distortions having substantially non-linear harmonics, which may easily be detected and evaluated by appropriate sensors, which if appropriate include filter systems.

As already stated, the excitation frequencies of the magnetic fields differ so much in frequency that a constantly varying overall magnetic field is formed by the two alternating magnetic fields of the excitation systems within the surveillance area, in the manner of a "beat". This overall magnetic field changes its direction and the distribution of its field lines so randomly within the surveillance area, as regards one looking in from the outside, that no predictions may be made regarding the momentary distribution of the magnetic field lines. It is thus impossible for this reason to fool the magnetic field and to move the object carrying the magnetic element through the surveillance area in such manner that no signal transmission occurs. Two different frequencies must however be generated and kept relatively constant with respect to each other to be able to engender the beat; beyond this, the possibility exists of the beat frequency becoming manifest in disturbing manner and attracting notice by humming, chirping or the like. Since the surveillance devices moreover are not always switched on, the state of lack of readiness of such a plant to operate may easily be detected if it emits noises in the normal case, which may result in misuse.

Consequently, an advantageous development of the present invention consists in that although the alternating magnetic fields of both generator systems are mutually coupled to form a common magnetic field, the excitation frequencies of the two magnetic fields are however equal to each other and with respect to each other have a constant phase shift, in such manner that a travelling overall magnetic field is generated which changes constantly and rapidly in respect to direction, strength and position. This yields the advantage that the constancy of the frequencies of the individual excitation frequencies need no longer be considered in essence because it is immaterial whether the frequency generated amounts to a few cycles per second more than a particular datum frequency which is empirical in any event but preferably amounts to approximately 10 kc/s, or to a few cycles per second less.

A phase shift of 90° is particularly advantageous in this connection, since distinctly differing field distributions are caused thereby.

No amplitude, frequency and/or phase modulations of the basic oscillations occur, nor do any higher-frequency components occur, which could have a disturbing effect. In this embodiment the inventive system is structured particularly simply and may preferentially be operated with a single oscillator only.

The system for preventing thefts from stores includes the marking element already referred to in the foregoing, which may be deactivated and is secured on objects which reach the surveillance area. The magnetic field generated by the higher-frequency harmonic oscillation is present in this surveillance area, and the deactivable marking element responds to this magnetic field, presupposing that it has not been exposed beforehand to the action of another powerful and directional magnetic field for the purpose of deactivation. In deactivation, a highly coercive material arranged on the marking element is placed into a state of permanent magnetisation.

A deactivable marking element of this nature is known from U.S. Pat. No. 3,820,104, to which also relates U.S. Pat. No. 3,820,103, which in particular discloses a co-ordinated system for detection of the marking element within the surveillance range.

Forms of embodiment of such deactivable marking elements are apparent, for example, from FIGS. 8 to 13 of the specification of U.S. Pat. No. 3,820,104. If the marking elements disclosed in that patent are examined more searchingly, it is possible to observe, as will be set forth herein after, that special conditions must be complied with during deactivation in order to deactivate the marking element unobjectionably, which is absolutely necessary so that no embarrassing situations occur for the purchaser after paying for the goods as normal, either directly upon leaving the store premises or else at any later date. This deactivation may be achieved without difficulty with respect to the present invention, so that it is assured in any circumstances that the marking element retains its deactivation, whereas in the case of the known marking elements, it is necessary that the deactivating directional magnetic field be brought into action in a quite particular manner. This is not possible under all circumstances, and it must also be expected that the sales personnel does not always comply precisely with the proper handling of the marking element. In the case of the known marking element, it is advantageous that in the deactivating system which generates the directional magnetic field, one only of the marking elements should in each case be deactivated at the predetermined instant, because the deactivating operation cannot be supervised properly in view of the required precise directional setting of the marking element with respect to the active directional magnetic field upon introducing several marking elements into the deactivating system at the same time and in non-directional relationship to each other. As for the rest, the deactivating system is constructed, for generating a sufficiently powerful directional magnetic field, as a cavity with an enveloping coil winding, to which is briefly applied the heavy current generating the required magnetic circulation, from previously charged capacitor batteries. Because of the need to recharge the capacitor batteries before each deactivating action, a relatively large expenditure of time is required for this reason for the deactivating action, if one marking element only can be dealt with at any one time. The present invention consequently also incorporates improvements in the deactivable marking element, which is now so constructed in accordance with the invention, that deactivation may be performed certainly and reliably at any optional orientation of an active directional magnetic field. The marking element will be dealt with in particular in the following.

BRIEF DESCRIPTION OF THE DRAWINGS

The invention will now be further described, by way of example, with reference to the accompanying drawings, in which.

DETAILED DESCRIPTION OF THE EMBODIMENTS

Figure 1:
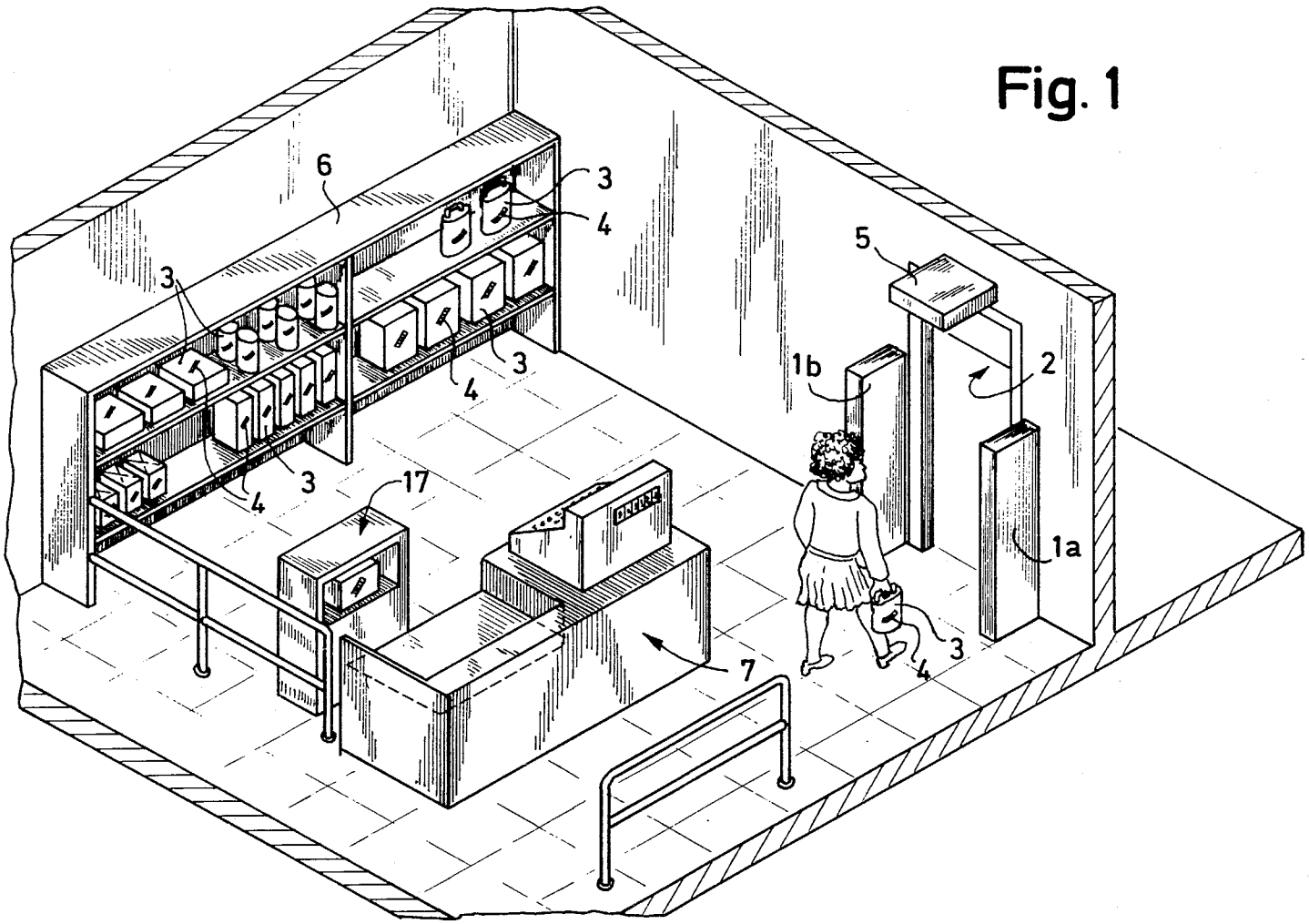
FIG. 1 generally and schematically illustrates a typical store comprising stock shelves, cash register and exit surveillance area, FIG. 2 in diagrammatical block diagram illustration, which shows an embodiment for generating a magnetic field which constantly changes its directional setting and configuration within the surveillance area and is consequently a travelling magnetic field.

It has already been pointed out in the foregoing that blind spots may result in the surveillance area in the case of the known system, inasmuch as the marking element may be moved through the surveillance area in such manner that no conjoint action on the same by the two magnetic fields occurs, so that the non-linearity of the marking element is unable moreover to engender any differential frequency which could thereupon be picked up by an appropriate system selectively detecting this differential frequency. If the illustration of FIG. 1 is considered in this connection, the two systems generating a magnetic field, for example coil windings and the like, are then generally marked 1*a* and 1*b*. By definition, the surveillance area is consequently formed at the point where in the area of the door exit 2, a purchaser leaves the store premises with the merchandise 3.

The merchandise 3 is provided with a marking element 4 which in the present case and as will be set forth in further detail in the following, has been processed so that the surveillance system does not respond. The surveillance system also comprises a sensor circuit 5 which detects betraying signals, which are generated when the marking element 4 on the merchandise 3 has not been processed in appropriate manner during a regular purchase. In the selling area, a set of shelves holding goods provided with the marking elements 4 is also illustrated diagrammatically at 6; finally, a cash register section 7 is incorporated over which pass the goods paid for as normal, and where the necessary processing of the marking elements 4 takes place.

In the embodiment shown in FIG. 1, the excitation coils for the two alternating magnetic fields formed within the surveillance area 2 are installed within the systems 1*a* and 1*b* situated at either side of the door aperture. The two magnetic fields generated by the excitation coils concomitantly form a common magnetic field in the surveillance area.

Figure 2:
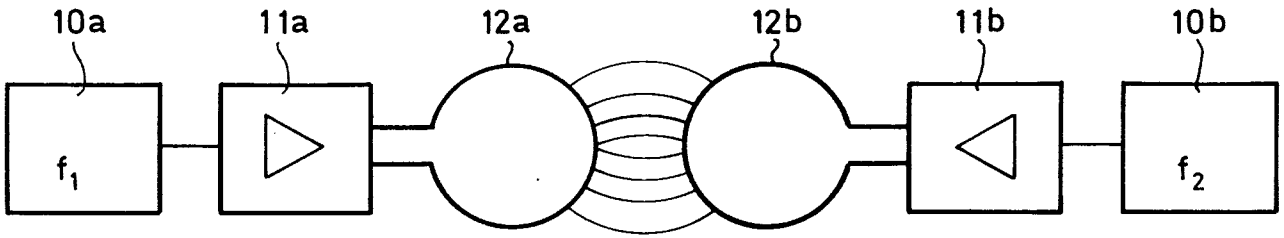

The illustration of FIG. 2 diagrammatically shows two oscillators or oscillation generators 10*a* and 10*b* to the outputs which are connected, in the illustrated embodiment, amplifier systems 11*a* and 11*b* which are so constructed that the alternating currents generating the magnetic fields which are supplied by the amplifiers to the excitation coils 12*a* and 12*b* which form the surveillance area between the coils, are shielded so that the systems 10*a*, 11*a*, 12*a* on the one hand and 10*b*, 11*b* 12*b* on the other hand do not affect each other, and so that no superimposition and modulation frequencies are engendered for as long as no marking element is present within the surveillance area. The shielding of the two circuits ensures that each of the coils 12*a*, 12*b*, which are shown merely diagrammatically in FIG. 2, transmits only the magnetic field generated by it at the frequency, without being affected by the other coil. A common overall field, which will be dealt with in the following, is then formed within the surveillance area depending on the particular momentary condition of the two alternating magnetic fields.

It is essential in any case that every item of merchandise which is carried out of the store premises via the exit area must also traverse the corresponding surveillance area.

Figure 4:
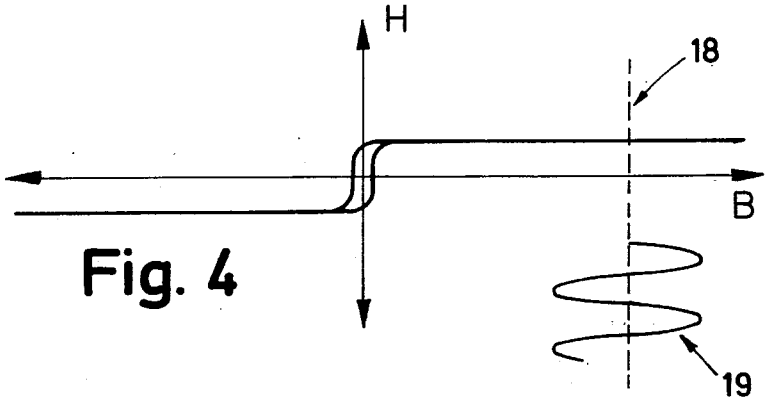
FIG. 4 shows the correlation of the induction B as a function of the field strength H in the case of a preferred marking element.

The operation which ensues if an article is taken away without passing through the store checkout, that is to say in an unauthorised manner, will be described initially in the following. As already stated in the foregoing, the merchandise has situated on it a marking element 4 which in the simplest case is a strip of a magnetically highly permeable material, for example a material such as "Supermalloy". The relationship of the induction B and the field strength H in the case of a piece of material of this kind is shown in FIG. 4; it is apparent that if a piece of such material is exposed to a magnetic field strength H varying at desirable frequency, the induction B does not follow the field strength linearly in view of the hysteresis loop which must be traversed during magnetic reversal, but distortedly, so that such a piece of material is apt to generate harmonics of the excitation frequency and to transmit the same. Non-linear harmonics of the excitation frequency normally result in case of distortions attributable to magnetic actions; frequencies which differ from the excitation frequency of the alternating magnetic field and which are at least twice, preferably three times and generally expressed in times as great as the fundamental excitation frequency, are generated in any event however at the instant in which a piece of magnetic material of appropriate design is present within the surveillance area. These harmonics which are generated in the surveillance area if a marking element which has not been exposed to an initial treatment, that is to say which has not been deactivated, is carried through the surveillance area, need not be very powerful since it is possible to detect even weak signals with the reliability required, by means of appropriate circuitry which is not dealt with in detail in the following.

As shown in FIG. 1, a sensor circuit 5 which responds to the harmonics generated and causes a corresponding signal transmission, is consequently situated close to or within the surveillance area. This signal may for example be a flashing light or a siren. It is also possible to bolt the exit area automatically until the matter has been clarified. The sensor circuit detecting the harmonics may moreover also be formed by the actual excitation coils 12*a* and 12*b* or be situated in their areas. Appropriate circuitry arrangements may be made by one versed in the art.

It is evidently necessary to be able to reliably prevent the marking elements from inducing an alarm signal when a purchaser passes through the surveillance area with an item of merchandise which has been correctly acquired.

In this case, a simple possibility would be to remove the marking element from the merchandise; this is not however always possible and may in particular cases even be extremely undesirable since such a possibility would also be available to an unauthorised purloiner.

Figure 6:
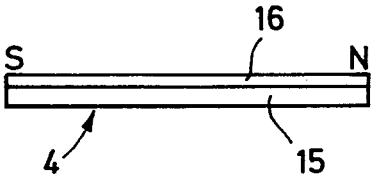
FIG. 6 shows a preferred marking element.

For this reason, the procedure applied in a preferred example of embodiment is that the first layer of material 15 consisting of the Supermalloy material for example, as shown in FIG. 6, is arranged adjacently to a second layer of material 16 of very high coercivity, that is to say a material which may be shifted into the state of a permanent magnet without difficulty, by the action of a suitably powerful magnetic field.

In the example illustrated in FIG. 1, a system 17 is situated in the area of the checkout, which acts with a powerful magnetic field on each marking element running over the checkout table, in such a manner that the ferromagnetic material 16 is magnetised and is formed into a magnet having a north pole and a south pole. The magnetic field lines emerging from this magnet also pass through the adjacent soft iron material 15 of high permeability, whereby the same is driven far towards saturation and reaches a state of magnetization which is marked by the reference 18 in FIG. 4. It is plainly apparent that, in this case, an alternating magnetic field acting on the strip of material 15, as shown at 19 in FIG. 4, is no longer able to pass through the hysteresis range so a nonlinearity does not result. A marking element of this kind is thus deactivated and a traversal of the surveillance area with a marking element of this kind does not trigger any signal.

The circumstance that it is merely necessary to carry the marking element 4 into the surveillance area somehow, in such manner that it is picked up by a magnetic field prevailing therein, whereby the said generation of harmonics is caused, is particularly advantageous in the present invention. It is unnecessary as already stated in the foregoing with reference to the prior art for both magnetic fields generated at different frequencies to act simultaneously on the marking element, so that a summation or differentiation frequency of the two excitation frequencies, engendered by modulation, may finally be detected by a sensor circuit. As a matter of fact the result in the said prior art is much more frequently the probability that one only of the magnetic fields can act fully on the marking element, and that the differential frequency cannot be generated or only with inadequate power, possibly because of the weakness of the other magnetic field which may be caused by the spatial position of the marking element. Because in the present embodiment, provision is made solely for the generation of harmonics, that is to say of transmissible frequencies, which are at least twice as high as the excitation frequencies, it is assured on the one hand that an emission of a signal occurs under any optional action of a magnetic field on the marking element; on the other hand, it is assured that, in the absence of a marking element, no interference frequencies arise which may for example also be considered as being interference frequencies in another connection. Alternating components of higher frequency are generated solely in case of a signal emission caused by a deactivated marking element.

On the basis of the inventive presuppositions, it is particularly advantageous however that, in a design of this kind, the elimination of the already cited so-called blind spots should succeed practically completely within the surveillance area since the two excitation frequencies $f1$ and $f2$ for the alternating magnetic fields within the surveillance area are so devised that a (mutually) superimposed overall magnetic field is the result, that is to say in the manner of a beat which is exposed to a continuous variation, a continuous travel and variation of the amplitude and orientation of the magnetic field strength consequently occurring within the space of the surveillance area.

Figure 3C:
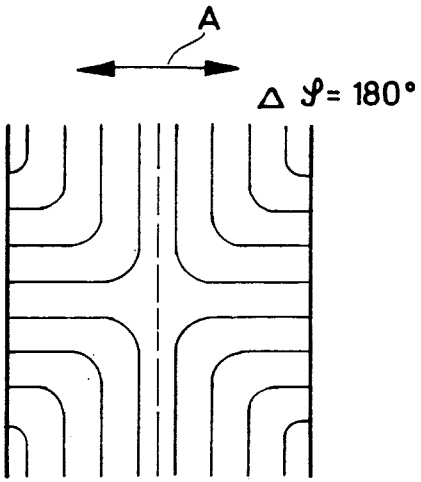
FIGS. 3*a*, 3*b* and 3*c* show diagrammatically alternative embodiments of the magnetic field within the surveillance area.
Figure 3B:
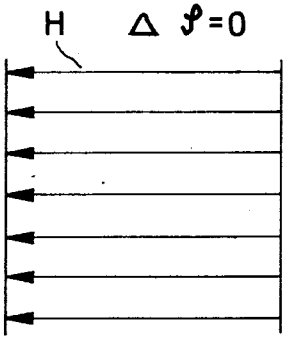
Figure 3A:
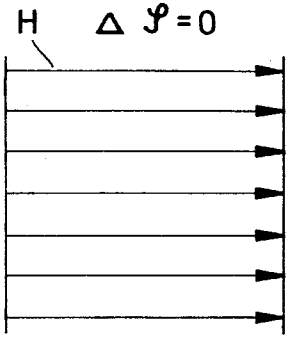

If the two excitation frequencies $f1$ and $f2$ are selected as 9.8 kc/s and 10 kc/s respectively, for example, the alternating magnetic fields generated by impressed currents in the excitation coils 12*a* and 12*b* form, in the manner of a beat, an overall magnetic field which may assume the most varied configurations, whereof three possible embodiments are illustrated in FIGS. 3*a* to 3*c*. FIG. 3*a* shows the construction of a magnetic field prevailing in the surveillance area, which is engendered at the instant in which the two alternating magnetic fields have the phase difference $\Delta\Phi = 0$.

An overall magnetic field is the result, which may extend from the left towards the right as in FIG. 3*a*, or in the other case of FIG. 3*b*, from the right towards the left at the phase difference angle $\Delta\Phi = 0$. This depends on the momentary polarity of the alternating excitation currents. FIG. 3*c* finally also shows the case of the phase difference angle $\Delta\Phi = 180°$; at this instant, the two alternating magnetic fields generated are directed towards each other and the configuration of the magnetic field lines diagrammatically shown, is established. Since the phase difference angle $\Delta\Phi$ varies continuously at the beat required and the constant frequencies *f*1 and *f*2 of the impressed currents, the structure, the configuration, the polarity and the spatial displacement of the magnetic field lines generated within the surveillance area, also vary continuously. For example, the centre line of FIG. 3*c* is displaced towards the left or right according to the double-headed arrow A, depending on the particular excitation system in which the excitation current approaches its zero traversal in each case.

It becomes understandable that such rapid travelling displacements of the magnetic field within the surveillance area ensure that the problem of the blind spots is eliminated; it is assured in particular that no path which could reliably prevent a detection of the non-deactivated marking element can be found through the surveillance area even by tricky attempts.

It is evident that the invention can have numerous modifications. In particular the marking element need not be constructed as indicated in FIG. 6, since a plurality of possibilities exists of bringing the marking element into a state such that a magnetic field action does not have the reaction of the generation of harmonics. For example, it would also be possible to specify a variation of the magnetic properties as a whole, in such manner that the permeability of the marking element is reduced by order of magnitude by an appropriate cold upsetting operation, by the action of mechanical or magnetic power.

Instead of the supply with an impressed current, it is also possible to operate with an alternating voltage source. This has the result that no modulation frequencies or harmonic frequency bands which are either disturbing or could lead to an automatic emission of an alarm do not already occur within the generator range and in the absence of a marking element.

Figures 5A, 5B, 5C:
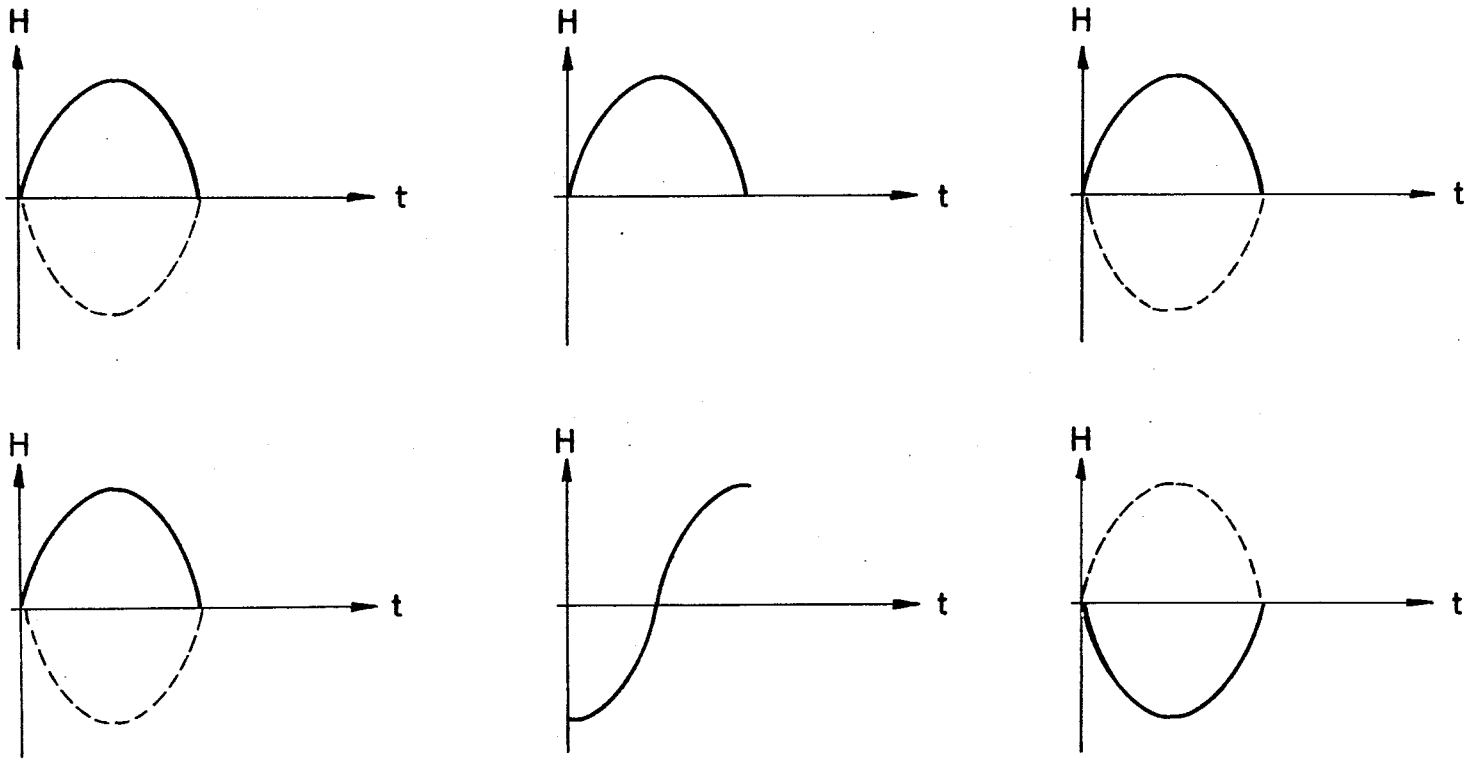
FIGS. 5*a*, 5*b* and 5*c* show illustrations of the alternative phase positions of the two magnetic fields.

Different phase settings of the currents flowing through the exciter coils 12*a* and 12*b* are also illustrated in FIGS. 5*a*–5*c*. In FIG. 5*a*, both currents are in phase, i.e. the magnetic field lines which depart from the two exciter coils, point in the same direction so that a powerful common magnetic field pointing in this direction is established, as shown for example in the illustration of FIG. 3*a*. It is evident that the two magnitude fields may also have the opposite sign as shown dotted in FIG. 5*a*, since they are generated by an alternating current of high frequency. The result then is an opposite course of the magnetic field lines as shown by the illustration of FIG. 3*b*. On the other hand, the two fields may however also have a phase shift of 180° as shown by FIG. 5*c*, i.e. they operate in phase opposition. The field distribution of the illustration of FIG. 3*c* is then the result. A phase displacement of 90° is what the currents of FIG. 5*b* have. A continuously changing condition of the magnetic field distribution in the surveillance area is the result of this phase difference.

In accordance with other embodiments of the present invention, it is possible furthermore to build up the overall magnetic field in the surveillance area in such a manner that the exciter coils are acted upon by an alternating current or an alternating voltage so that only the frequency of the quantity feeding one coil is kept constant, whereas the frequency of the other, feeding alternating voltage quantity, which may for example be equal to or different from the first frequency, is modulated by a predetermined frequency variation. The frequency of the beat generated for the purchaser within the surveillance area varies in practically unpredictable manner, in this way.

On the other hand, it is also possible to keep one frequency constant and to modulate the other frequency in its phase with respect to the first, both feeding alternating amplitudes having the same fundamental frequency, and it is finally also possible to make both frequencies identical but to modulate both in opposition in their phase.

Quite generally speaking, it is possible by modulation applied to frequency or phase of one or both feeding alternating current amplitudes, to operate these with identical fundamental frequencies, for example to specify a common oscillator frequency of 10 kc/s for both and then to modulate one or both. As a last possibility, both feed frequencies could also be modulated in opposition in their frequency or phase: a corresponding variation of the magnetic field structure always occurs in the surveillance area, in which connection the marginal field conditions in particular also vary and move constantly.

If the phase of one or both alternating feed quantities is modulated, two degrees of freedom result again in this case, in which connection it is possible to decide how extensively to modulate the phase and at what frequency the phase modulation should occur. It is precisely in the case of phase modulation that the magnetic field variation in the surveillance area may best be correlated, because the most favourable phase settings and moreover a frequency for the phase modulation which is most advantageously appropriate for the prevailing spatial conditions may be adopted.

Figure 7:
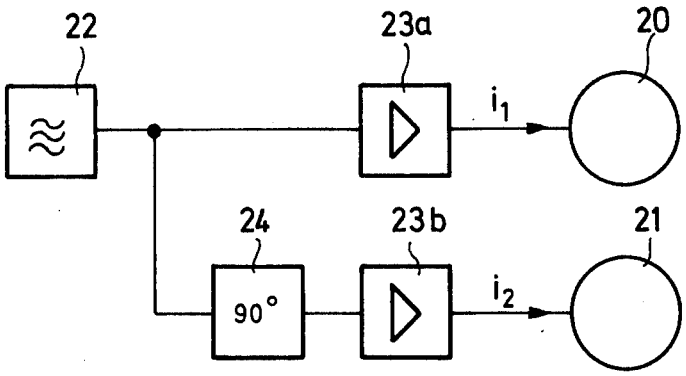
FIG. 7 is a diagrammatic block diagram illustration showing a complementarily preferred fundamental circuit for application of the inventive method.

The surveillance system may be simplified considerably and improved in its mode of operation, if the excitation frequencies of the two magnetic field are identical, but have a constant phase displacement with respect to each other. It is apparent from the illustration of FIG. 7 that a common oscillator 22 is preferentially incorporated for generating an excitation signal of predetermined frequency, for example a sinuoidal voltage having a frequency of 10 kc/s. The coils 20 and 21 are then fed via amplifier circuits 23*a* and 23*b* which have fed to their input terminals the excitation signal of the oscillator 22, the feed currents specified being those which correspond to the field strength H generated, in respect of phase and amplitude.

The amplifiers 23*a* and 23*b* are preferably so constructed that the currents fed to the coils 20 and 21 are mixed; alternately, the coils could also be fed from a generating source of alternating current with. It is accomplished thereby that modulation frequencies or harmonic frequency bands which are either disturbing or could result in an automatic alarm transmission are not generated within the generator range in the absence of a marking element.

Figure 8:
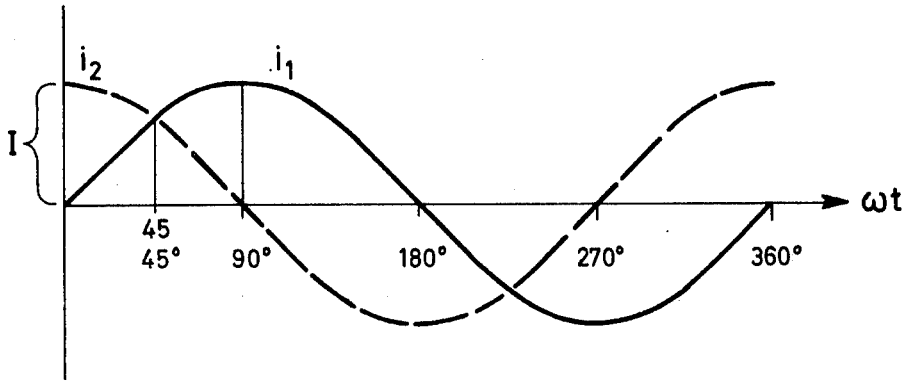
FIG. 8 shows the phase settings of the two currents fed to the so-called gate coils, which are preferentially applied.

The output currents $i_1$ and $i_2$ of the amplifiers 23*a* and 23*b* are illustrated in FIG. 8 in their preferred mutual phase setting corresponding to a phase displacement of 90°, i.e. with reference to the co-ordinate origin, the current $i_1$ is a sine wave, and the current $i_2$ a cosine wave. The phase displacement between these two currents may be obtained by means of a phase changer 24, FIG. 7, which may for example be connected in front of the amplifier 23*b* and which establishes a phase displacement of 90° in this example. The phase changer 24 may also be incorporated behind the amplifier 23*b*; it is however appropriately situated in the input circuit of the amplifier 23*b* since it may be designed for a lesser rating in this case. The output signal of the common oscillator 22 consequently passes direct to the input side of the amplifier 23*a* and via the phase changer 24 to the input side of the amplifier 23*b*.

The graph of the two currents $i_1$ and $i_2$ may be illustrated by the two known following formulae, from which the mutual phase setting also becomes apparent:

$$i_1 = I \sin \omega t$$

$$i_2 = I \sin (\omega t + 90°)$$

As apparent to one versed in the art, the currents $i_1$ and $i_2$ fed to the two coils 20 and 21 generate corresponding magnetic fields starting from the coils, which are combined into an overall magnetic field as shown in the following FIGS. 9*a* to 9*f*, which is subjected to constant transformation of its structure and of the direction of its field lines and which may best be described as a "travelling magnetic field".

Figure 9A:
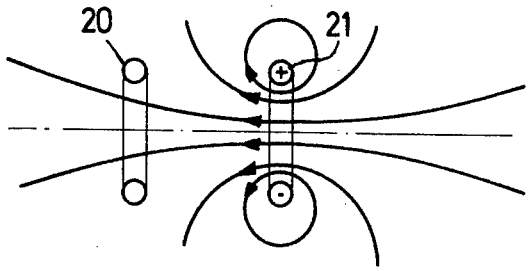
FIGS. 9*a*–9*f* show the distribution of the field lines of the overall magnetic field formed in each case during a half-oscillation of the basic oscillation at constant phase shift of 90° at different instants in this embodiment, FIG. 10 finally shows the possible form of embodiment of a known marking element, which is specified for clearer comprehension.
Figure 9B:
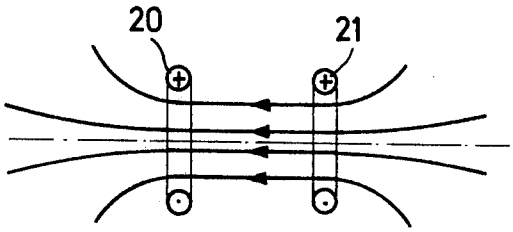
Figure 9C:
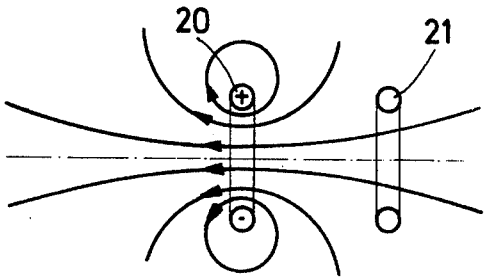

The generation and distribution of the field lines will also be dealt with briefly in the individual FIGS. 9*a* to 9*f*, in the following. FIG. 9*a* corresponds to the distribution of the magnetic field lines for the instant $\omega t = 0$, consequently at an instant in which the current $i_1$ and consequently the field strength generated in the coil 20 are equal to zero, and the field strength generated by the coil 21 is a maximum at maximum current ($i_2 = I$). At this time, most of the field lines are concentrated in the area of the coil 21 and have the direction indicated, some field lines also passing through the coil 20. The two currents are equal at the instant $\omega t = 45°$, i.e. $i_1 = i_2 = \frac{1}{2}\sqrt{2}\ I$ (FIG. 9*b*). A common magnetic field is the result, similar to the magnetic field which is generated by a cylindrical coil. At the instant $\omega t = 90°$, the magnetic field lines still retain their direction (FIG. 9*c*), but are displaced in their intensity into the range of the coil 20 since the current $i_2$ is equal to zero at this instant.

Figure 9D:
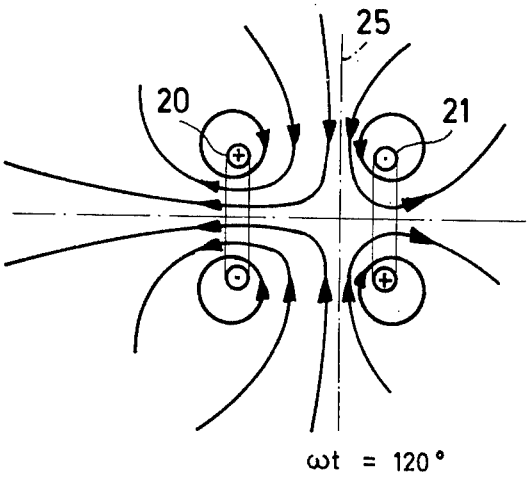
Figure 9E:
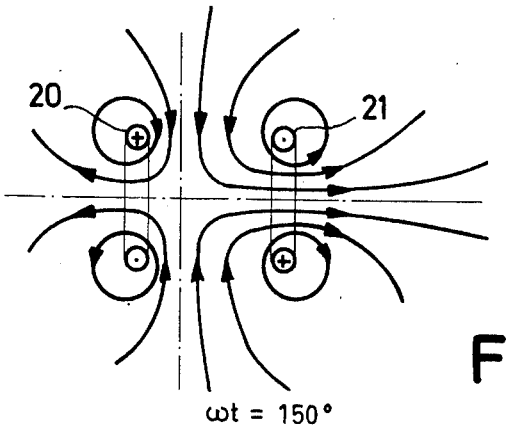
Figure 9F:
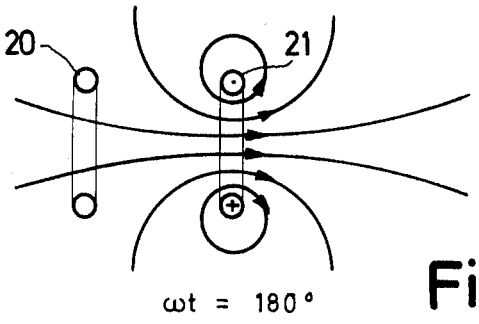

At another instant, when $\omega t = 120°$, contradirectional relationships of the field line distribution are developed in the surveillance area between the two coils, as shown in FIG. 9*d*. Since the current $i_2$ flowing through the coil 21 is negative at this time and similar than the current in the coil 20, a distortion of the magnetic field is the result, to the effect that a neutral area of parting plane 25 is situated closer to the coil 21; precisely the opposite occurs at an instant $\omega t = 150°$ as shwon by FIG. 9*e* and as may moreover easily be verified by reference to the graphs of FIG. 3*c*. At the instant $\omega t = 180°$, i.e. after a semioscillation, the result is again the field distribution corresponding to the illustration of FIG. 9*a*, merely with the difference that the direction of the field lines now extends opposed as shown at FIG. 9*f*. The field line distributions shown in FIGS. 9*a* to 9*f* are then repeated until the instant $\omega t = 360°$, with the difference that in this second half cycle, the direction of the field lines but not their configuration is reversed, i.e. the arrows drawn on the field lines reverse their direction.

It is apparent that the overall magnetic field built up within the surveillance area undergoes considerable changes in its structure, its direction and its total configuration spatially and chronologically during one oscillation of the fundamental oscillation, in which connection it should moreover be considered in particular that these changes in configuration occur with a frequency which corresponds to the frequency of the fundamental oscillation. This means that within a period of no more than 50 μsec, (corresponding to a half cycle of the fundamental oscillation) all the field distribution configurations corresponding to FIGS. 9*a* to 9*f* occur once with all the intermediate positions which evidently also occur, since the field distributions illustrated in FIGS. 9*a* to 9*f* merely show the distributions which result at particular and particularly easily verifiable times in the course of the fundamental oscillation half-wave. The changes obviously occur in continuous rapid and dynamic sequence, and it is readily apparent that such a distribution of the magnetic field lines reliably prevents the occurrence of so-called "blind spots".

Figure 10:
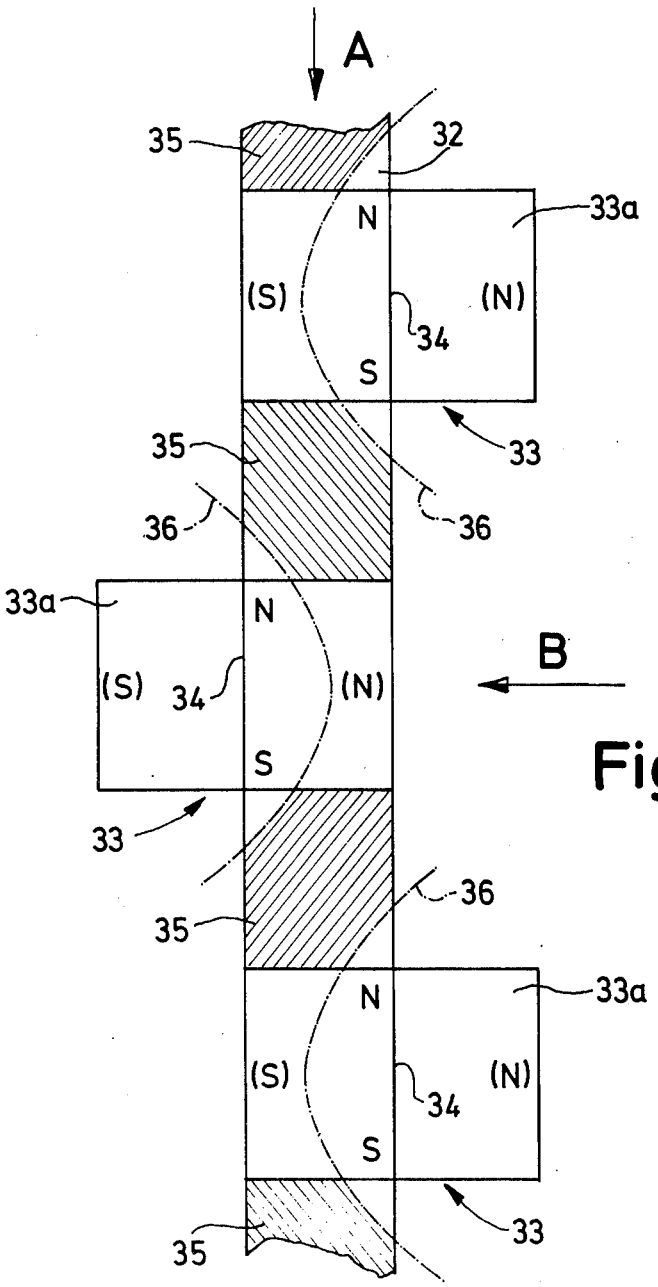
Fig. 10 PRIOR ART

In FIG. 10 is finally also illustrated the already cited known marking element, which consists of a strip 32 of highly permeable material, which as already stated in the foregoing may be energised to generate harmonics by an active varying magnetic field. Arranged in sections on the strip are rectangular pieces or parts of highly coercive material which may be magnetised into small magnets by a directional magnetic field. These pieces of material are identified by a numeral 33 in FIG. 10. Let it be assumed initially that, for the purpose of deactivation, the directional magnetic field acts in the direction (0°) corresponding to the arrow A. In conventional manner, north and south poles are then established on each section of material 33, as shown in FIG. 10. Since the sections of highly coercive material project to the extent of approximately half over the strip of material 32 in each case, and as shown in FIG. 10 are staggered with respect to each other, the projecting part 33*a* initially remains of no importance to the magnetisation of the strip of material 32 in this direction of magnetization. A wholly satisfactory and adequate magnetization of the strip of material is the result however, since the magnetic flux lines in each case flow from the north to the south poles in the area covered by the sections 33 of material and in the area of the strip of material 32 which is not covered, at whose adjacent marginal areas or edges different polarities of the sections of material are established in each case. This desirable field line extension, which causes of a complete deactivation of the marking element, changes however when the active directional magnetic field is brought into action only as corresponds to the direction of the arrow B, as one of many possibilities upon deactivation. In this case, the material sections 33 are magnetically polarised as shown by the notations (S) and (N) placed in brackets and relating to the south and north poles. In this possible action of the directional deactivating magnetic field in accordance with FIG. 13 of the U.S. Pat. No. 3,820,104, the fact that opposed polarities of the magnetic field are again established on the material strip 32, but that the passive portion of each small magnet so formed, which is present between the outer poles, as indicated at 34 is present on a marginal edge of the material strip 32 and one pole of each magnetic material section formed protruding freely outwards and having no connection with the material strip 32 was ignored. The other active pole is however equally situated on only one marginal edge of the highly permeable material and for a desirable flux between the remanently magnetic sections 33 it is consequently possible only to exploit a stray flux effect. The magnetic field lines in the material strip 32 then extend as shown at 35 in idealised form, in each case. Below the material sections 33 or rather in the area of the material strip 32 of permeable material covered by these material sections, a magnetic field line distribution results moreover which is hardly worth mentioning, since the magnetic field lines must, as is apparent, pass through air or another material which has a high magnetic reluctance, to reach the other pole of the same section in each case. In other terms, this means that after deactivation by the magnetic field B, considerable areas are formed in the material strip 32 which are approximately delineated by the dash-dotted lines 36 and wherein no adequately high magnetic field line distribution prevails, since these had not reliably or not sufficiently been driven into the saturated state during the deactivation. As already stated in the foregoing, these areas may then respond to the subsequently acting alternating magnetic field.

Complementarily, let it be pointed out that as discovered experimentally, the division of the highly coercive material into separate material sections is absolutely necessary, since a single uninterrupted strip of highly coercive material cannot drive a co-ordinated strip of highly permeable material sufficiently reliably into such a saturation state that the response to a magnetic alternating field is precluded. To summarise, it is consequently to be observed that in the case of the known marking elements, the deactivating action depends on the momentary orientation of the marking element with respect to the active directional magnetic field, and that orientation-dependent and not always unexceptionable deactivation states of the marking elements may result.

The special, mutually staggered arrangement projecting beyond the material strip of the material sections on the material strip has been selected in the case of the known marking element, to ensure that during the action of the deactivating magnetic field alternate magnetic poles are formed by the material sections in the longitudinal direction as well as in the transverse direction above the metal strip. The present embodiment of the invention is based on the surprising finding that this is unnecessary and that it is precisely in the case of material sections of highly coercive material covering the strip of material, that a deactivation of the marking element is obtained.

Since the material sections of the highly coercive material projecting laterally beyond the material may be omitted, considerable quantities of this material are saved and a marking element is obtained which is reliably deactivable in any orientation.

An example of an advantageous development of a marking element appertaining to the invention will now be described in particular with reference to the illustration of FIG. 11.

Figure 11:
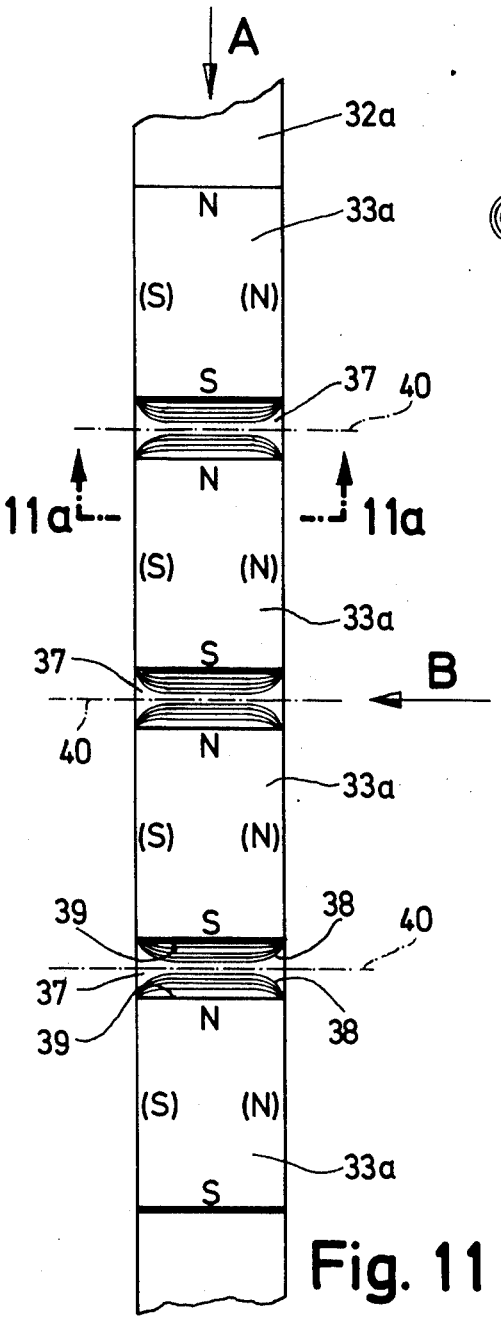
FIG. 11 shows an embodiment of marking element according to the invention.

In FIG. 11, the material strip bears the reference 32*a*; the material sections co-ordinated with them, and for example secured to them by means of an adhesive, bear the reference 33*a*. The material sections 33*a* are arranged at a mutual spacing 37 which will be dealt with in particular in the following.

The following mechanism of actions results during deactivation of such a marking element. If the deactivating magnetic field acts in the direction of the arrow A as already set forth in the foregoing with reference to the known marking element, the north and south poles are formed on the material section 33*a* as indicated in FIG. 11 and a corresponding magnetic flux through the co-ordinated material strip 32*a* of highly permeable material is the result, which may best be gleaned from the illustration of FIG. 12. In each case, the magnetic field lines extend from the north to the south poles of each material sections as well as in each case to the opposed poles of the adjacent material sections 33*a* always wholly through the material of the material strip 32*a*, so that its state of magnetization is displaced so far into the saturation range that an alternating magnetic field which may possibly act later, can no longer have any effect.

Figure 11A:
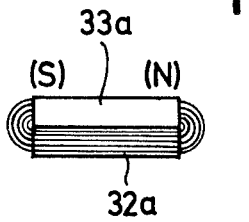
FIG. 11*a* shows as section through the marking element of FIG. 11 along the line 11*a*—11*a* of FIG. 11.

It is now unexpected however that even in the case of a magnetic field acting in transverse direction for deactivation according to the arrow B, a practically closed magnetization state may be accomplished in the marginal strip 32*a*. In this case too, the magnetic north and south poles (S) and (N) are formed again, as denoted by the notations set in brackets in FIG. 11. This means that the material of the material strip 32*a* situated directly below the material sections 33*a* is fully magnetised because the magnetic field lines issuing from the poles (S) and (N) wholly traverse the subjacent material area, as shown by the cross-sectional illustration of FIG. 11*a*.

An adequate magnetic flux is however still established in the cover-free interstitial areas 37 of the material strip 32*a*, since as indicated at 38 in FIG. 11, the magnetic field lines also penetrate into the interstitial areas at the marginal areas 39 of adjacent material sections 33*a*, so that a considerable stray flux results in this case, with a but narrow central area 40. The reason for this stray flux consists, not least, in that the very powerful magnetic flux of the material areas are situated covered under the material sections 33*am* allows the magnetic reluctance thereat to rise to such a degree that the magnetic field lines seek a path of lesser reluctance through the adjacent material set at a distance 37 of the highly permeable material, since the $\mu$ is even lower there than in the areas situated directly below or adjacently to the material sections 33*a*, which were driven extensively into the saturated stage.

Consequently, an essential feature consists in that the width, that is to say the dimension of the material sections 33*a* extending in transverse direction is only as wide as the width of the corresponding co-ordinated material strip, the material sections 33*a* being so arranged on the material strip 32 that a substantially symmetrical overlap is the result.

The spacing 37 between the material sections 33*a* on the material strip 32*a* is determined from two different parameters. The maximum spacing is so dimensioned that the neutral area 40 is kept adequately small or, expressed in other terms, that the stray flux areas 38 adjacent to each marginal area 39 of the material sections 33*a* substantially cover the spacing 37 and make provision for an adequate magnetic saturation even there.

Figure 12:
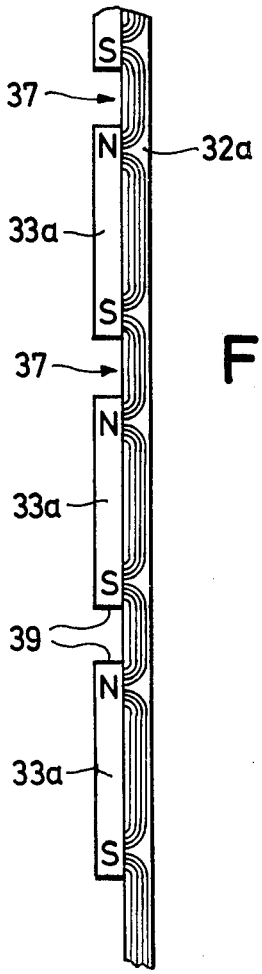
FIG. 12 shows the marking element of FIG. 11 in side view, so that the magnetic flux in particular is also apparent.

The minimum distance is determined from the requirement that the entire system comprising a longer one-piece material strip of highly permeable material and the individual laid-on or co-ordinated material sections 33*a* should not react like a single one-piece bar magnet, which would be the case if by reference to the practical technological embodiment the spacing were to be so small that the magnetic field lines bridge the air gap formed by this spacing and no longer pass through the corresponding material of the material strip 32*a*. In this case, the overall field line distribution, as shown in FIG. 12, would change considerably and a reliable deactivation would no longer be obtainable. The reason for the magnetic field lines to be prone to bridge the air gap in the case of a spacing less than the predetermined minimum spacing rather than flow through the co-ordinated highly permeable material, consists in that the material sections must be secured in some manner on the highly permeable material strip 32*a*, for example by means of an adhesive, and that a $\mu$ is also the result in this manner, which differs considerably from the $\mu$ of the soft iron, but must be traversed twice by the magnetic field lines, as is apparent.

Consequently, in practical examples, the distance 37 between adjacent materials sections 33*a* lies within the range of 1 to 2 mm.

Apart from the advantages already cited in the foregoing, such an optional directional orientation during deactivation and a particular saving of material of the highly coercive material, the advantage of simplified production also accrues, since the individual material sections need not be carefully arranged offset with respect to a centre line; the marking element may also be made narrower, which is always desirable.

We claim:

1. A method for detecting the presence of objects within a particular surveillance area, in particular for detection of shoplifting, comprising generating at least two alternating magnetic fields each of predetermined frequency in the surveillance area, affixing to the objects to be detected non-linear marking elements which upon being energized by an alternating magnetic field of predetermined fundamental frequency generate and transmit at least one harmonic signal which represents a multiple of the fundamental frequency, coupling the alternating magnetic fields to each other to form a common resulting magnetic field, and varying the alternating magnetic fields such as to form said common resultant magnetic field with a continuous charge in direction, strength and position within the surveillance area.

2. The method of claim 1 wherein the frequency of at least one of the alternating magnetic fields is frequency modulated.

3. The method of claim 1 wherein the frequencies of the magnetic fields are identical and have a constant phase displacement with respect to each other for forming the constantly varying resulting magnetic field.

4. The method of claim 3 wherein the frequencies of the magnetic fields have a relative phase displacement of 90°.

5. The method of claim 3 wherein the frequencies of the alternating magnetic fields are obtained from a single frequency generator feeding directly into a generating system for one of said magnetic fields and via a phase changer circuit into a generating system for the other of said magnetic fields.

6. The method of claim 1 wherein the frequencies of the magnetic fields are equal and are phase modulated.

7. A system for detecting the presence of objects within a particular surveillance area, in particular for detecting shoplifting, said system comprising two coil systems, each situated at one side of the surveillance area, means for applying alternating currents to each of said coil systems for producing within the surveillance area a resultant magnetic field changing in its spatial structural form in the manner of a beat within the surveillance area, a marking element secured on each of the objects and acted upon by the resultant magnetic field, wherein said means for applying alternating currents to each of said coil systems comprises frequency generators each connected to the input of one of said coil systems through an amplifier and wherein said frequency generators each produces a signal at a constant frequency different from that of the other.

8. A system for detecting the presence of objects within a particular surveillance area, in particular for detecting shoplifting, said system comprising two coil systems situated at opposite sides of the surveillance area, the coil systems having fed to them impressed alternating currents of equal and constant frequency, the currents having a particular phase displacement with respect to each other so that a resultant magnetic field changing constantly in its spatial structural forms is brought into action on a marking element secured to an object within the surveillance area, wherein the impressed alternating currents are produced by a single oscillator which generates a constant frequency, a pair of amplifier circuits acting each on one of the two coil systems, and a phase changer circuit connected between the oscillator and one of the amplifier circuits for engendering a constant phase displacement, wherein said marking element is a deactivable marking element which has at least one strip of ferromagnetic material of high permeability arranged in such manner as to have a non-linear behaviour under the action of an external alternating magnetic field so as to generate at least one frequency which is at least twice as high as the external frequency and a plurality of separate segments of material of high coercivity, said last mentioned material being magnetizable in such a manner that the strip of ferromagnetic material of high permeability is driven into such a magnetic saturation range that an outer external magnetic field remains within the linear saturation range of the hysteresis graph of said ferromagnetic material.

9. In a system for detecting the presence of objects within a particular surveillance area which comprises a pair of coil systems situated each at one side of the surveillance area, means for applying to the coil systems alternating currents for developing in the surveillance area a constantly varying resultant magnetic field of predetermined frequency for acting upon a deactivable marking element affixed to each one of the objects, said deactivable marking element comprising a material of high magnetic permeability adapted to emit a magnetic field of at least twice the frequency of the resultant magnetic field when exposed thereto prior to deactivation, the improvement for said deactivable marking element comprising a strip of said material of high permeability supporting a plurality of separate sections of said material of high magnetic coercivity, the sections being approximately equal to the width of the strip, wherein the ratio between the width of the strip and the length of each of the sections amounts to at most 1 to 4, wherein the minimum spacing between consecutive sections on the strip is so dimensioned that upon deactivation by means of a magnetic field acting in the longitudinal direction of the strip the flux lines of said magnetic field pass through the material of the sections and not through the air gap forming the spacing between consecutive sections, wherein the maximum spacing between consecutive sections is such as to create a stray flux in the air gap during deactivation by means of a magnetic field acting in a transverse direction to the strip, and wherein the sections are arranged symmetrically on the strip substantially without projections.

10. A system according to claim 9 wherein the sections of material of high coercivity are glued on the strip of material of high permeability.

11. A system according to claim 10 wherein the spacing between adjacent sections is between 1 and 2 mm.

* * * * *

UNITED STATES PATENT AND TRADEMARK OFFICE

CERTIFICATE OF CORRECTION

PATENT NO. : 4,123,749

DATED : October 31, 1978

INVENTOR(S) : Ernst-Gerhard Hartmann et al

It is certified that error appears in the above-identified patent and that said Letters Patent are hereby corrected as shown below:

Col. 6, line 47, change "at the frequency" to --at a predetermined frequency--.

Col. 11, line 40, change "similar" to --smaller--.

line 45, change "shwon" to --shown--.

Signed and Sealed this

First Day of May 1979

[SEAL]

*Attest:*

RUTH C. MASON
*Attesting Officer*

DONALD W. BANNER
*Commissioner of Patents and Trademarks*